US008370968B2

(12) United States Patent
Kerr

(10) Patent No.: US 8,370,968 B2
(45) Date of Patent: Feb. 12, 2013

(54) CERVICAL SPINE PROTECTION DEVICE

(76) Inventor: Patrick E. Kerr, New York, NY (US)

( * ) Notice: Subject to any disclaimer, the term of this patent is extended or adjusted under 35 U.S.C. 154(b) by 840 days.

(21) Appl. No.: 11/334,260

(22) Filed: Jan. 18, 2006

(65) Prior Publication Data

US 2007/0163032 A1 Jul. 19, 2007

(51) Int. Cl.
*A41D 13/00* (2006.01)
*A41D 27/26* (2006.01)

(52) U.S. Cl. ..... 2/468; 2/459

(58) Field of Classification Search ..... 2/459, 461, 2/415, 411, 468, 44, 300, 462; 602/18, 61, 602/74; D21/788; D29/101.2, 100; D24/191; D2/600, 602; 128/846, 869, DIG. 23
See application file for complete search history.

(56) References Cited

U.S. PATENT DOCUMENTS 3,189,917 A * 6/1965 Sims ..... 2/415
4,094,015 A * 6/1978 Howard ..... 2/415
4,338,685 A * 7/1982 LaPorta, Jr. ..... 2/462
4,501,023 A * 2/1985 Bilberry ..... 2/462
4,821,339 A * 4/1989 Fair ..... 2/462
4,996,720 A * 3/1991 Fair ..... 2/462
5,334,442 A * 8/1994 Okamoto et al. ..... 442/224
5,404,590 A * 4/1995 Monica, Jr. ..... 2/468
6,058,517 A * 5/2000 Hartunian ..... 2/468
6,874,170 B1 * 4/2005 Aaron ..... 2/468

* cited by examiner

*Primary Examiner* — Amber Anderson
(74) *Attorney, Agent, or Firm* — Jones Day

(57) ABSTRACT

Disclosed is a cervical protective device that reduces the possibility of neck injuries in contact sports. In a preferred embodiment, this device is worn in conjunction with a football helmet and football shoulder pads. Without restricting normal movement of a football player, the device contacts the lower most parts of the sides of the helmet and has a shape that is molded as to the normal anatomy of the upper back and lower cervical spine. The device contacts the lower sides of the player's neck and is held in place by the shoulder pads as normally worn by football players. Force received at the top of the helmet is applied to the protective device, absorbed by compression elements contained within the protective device and the force is directed away from the cervical spine.

18 Claims, 5 Drawing Sheets

CERVICAL SPINE PROTECTION DEVICE

FIELD OF THE INVENTION

The present invention relates generally to protective gear for use in conjunction with contact sports and more particularly to a cervical spine protection device that minimizes damage to the spinal column and spinal cord while allowing unrestricted movement of the head and neck during athletic activity.

BACKGROUND OF THE INVENTION

Injuries to the neck are some of the most serious injuries in contact sports. For example, hyperextension of the neck to the rear can cause permanent damage to the spinal cord and can result in paraplegia, quadriplegia and/or other forms of paralysis. If the neck is bent excessively to one side, the nerves in the brachial plexus can be stretched to cause what is commonly known as a "pinched nerve." In severe cases, excessive lateral cervical flexion can cause permanent and irreparable damage to the nerves of the brachial plexus. Furthermore, undue flexing of the neck at an angle to the rear and to one side can result in equally serious damage to the cervical spine, brachial plexus and/or adjacent areas of the neck and upper back.

The most serious of injuries occur when the head is driven down toward the neck and shoulders producing an excessive pressure that the cervical spine cannot handle. This pressure causes a buckling of the column and may lead to disc herniation, muscle and ligament damage, and potentially spinal cord injury.

While neck injuries have been recognized as a serious problem in contact sports, very little progress has been made in developing protective athletic equipment that protects the athlete's neck without restricting his normal movement.

A number of prior art devices have been designed to reduce injuries to the necks of players in contact sports. These devices include U.S. Pat. No. 3,189,917 to Sims, U.S. Pat. No. 3,497,872 to Mitchell, U.S. Pat. No. 4,094,015 to Howard, U.S. Pat. No. 4,338,685 to LaPorta, U.S. Pat. Nos. 4,821,339 and 4,996,720 to Fair, U.S. Pat. No. 5,404,590 to Monica, U.S. Pat. No. 5,546,601 to Abeyta, U.S. Pat. No. 6,058,517 to Hartunian, and U.S. Pat. No. 6,874,170 to Aaron.

The devices exemplified by the above-mentioned references primarily attempt to reduce the flexion, extension, lateral bending, and rotation of the head. However, none of the devices disclosed in the above-mentioned references decrease axial compression of the neck without limiting the normal movement of the head of the user, nor do these references provide the degree of support provided by the disclosed invention.

For example, Sim's device is elevated in the rear to contact the back portion of the helmet during the extension of the neck of the user, effectively restricting the backward movement of the head of the user. Sim's device is also tapered in the front and connected with a lace. Mitchell's device is to be worn on the top of the shoulder pads and is attached to the shoulder pads by strings that hold it in the proper position. Mitchell's device is thick and four-sided with rounded edges. As appreciated by those skilled in the art, Mitchell's device prevents the normal movement of the player's neck. Aaron's device is attached to the helmet and shoulder pads by fasteners that inevitably restrict the normal movement of a player's head and neck. LaPorta's device has back and chest plates that are attached using a curved pad providing little or no support in minimizing damage to the spine. Howard discloses a neck cushion that is an integral part of the helmet. The back of the cushion is raised, inevitably restricting the movement of the user.

Fair '339 and Fair '720 disclose a protective vest having a collar guard designed to engage with the player's neck or helmet with no spine protection. Hartunian discloses a foam neck brace surrounding the user's neck with 360 degrees of cushioning. The brace is secured in place using a strap and fasteners. The conical shape of the neck brace and the way it surrounds the neck of the user inevitably prevents the normal motion of the user. Monica discloses a helmet motion restrictor designed to engage with the football helmet of the user in order to prevent excessive lateral and posterior movements of the football helmet again restricting movement. Abeyta discloses a cervical spine protection device designed to minimize the axial compression of the head of the user, which unduly restricts the posterior and anterior movements of the neck of the user.

It is, therefore, an object of the cervical spine protection device of the present invention to reduce axial loading of the spine without limiting movement in flexion, extension, left or right lateral flexion or rotation of the skull.

It is a further object of the cervical spine protection device of the present invention to engage the lower most part of a helmet during axial compression so as to relieve the pressure on the spine.

It is a further object of the cervical spine protection device of the present invention to be worn with various types of regulation helmets and regulation shoulder pads, so as not to interfere with the movement of the head of the user, or the normal workings of the helmet or the shoulder pads.

It is a further object of the cervical spine protection device of the present invention to provide a cervical spine protection device that is simple to use, lightweight and economical to construct.

SUMMARY OF THE INVENTION

The cervical spine protective device of the present invention is designed to reduce the possibility of neck injuries in contact sports, without restricting the normal neck movement of a player during collision. In a preferred embodiment, the device of the present invention contacts the lower most parts of the sides of a player's helmet, and has a shape that is molded to the normal anatomy of the upper back and lower cervical spine. Force received at the top of the helmet is applied to the protective device, absorbed by compression elements contained within the protective device and directed away from the cervical spinal column while allowing extension of the head and neck. It is a feature of the present invention that the compression elements direct axial force away from the spine area. Though the embodiments of the present invention reduce axial load in an attempt to reduce forces from the head toward the neck, one skilled in the art will understand that there is no protecting the neck in all incidences of collision.

These together with other objects and features of the invention are pointed out with particularity in the claims annexed hereto and forming a part of this disclosure. For a better understanding of the invention and its operating advantages, reference should be had to the accompanying drawings and descriptive matter in which there is illustrated a preferred embodiment of the invention.

DETAILED DESCRIPTION OF THE INVENTION

Figure 1:
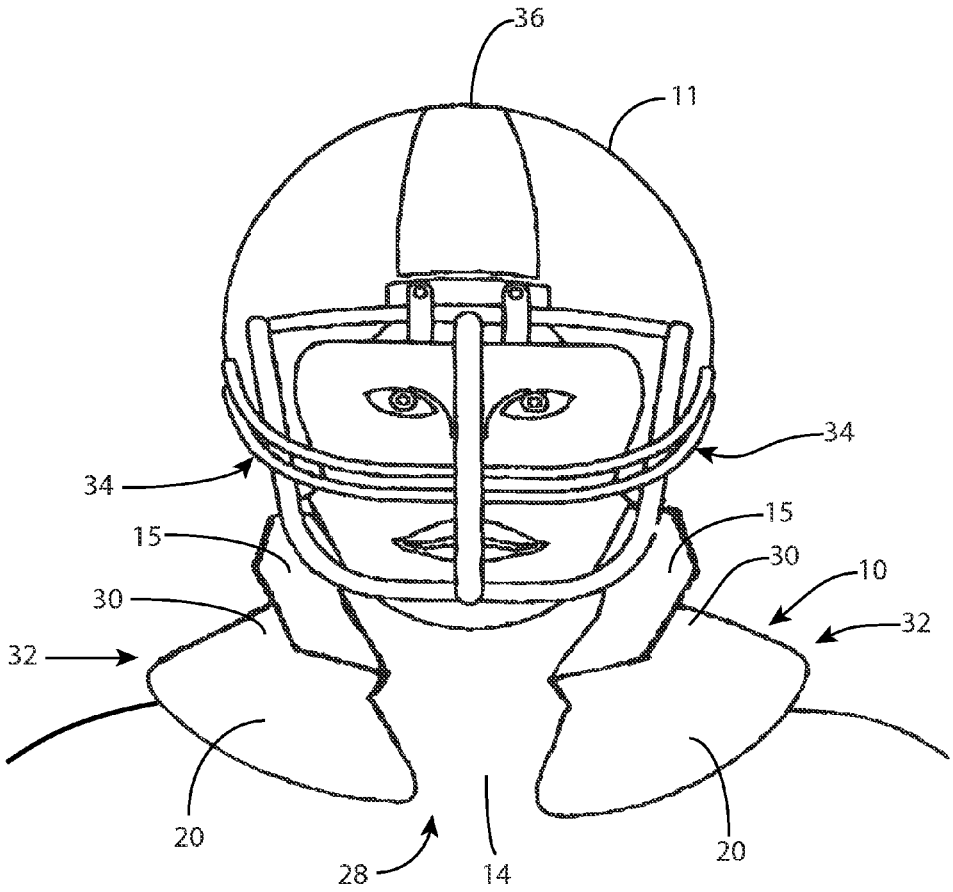
FIG. 1 is a front view of the cervical spine protection device as worn in conjunction with a football helmet.
Figure 2:
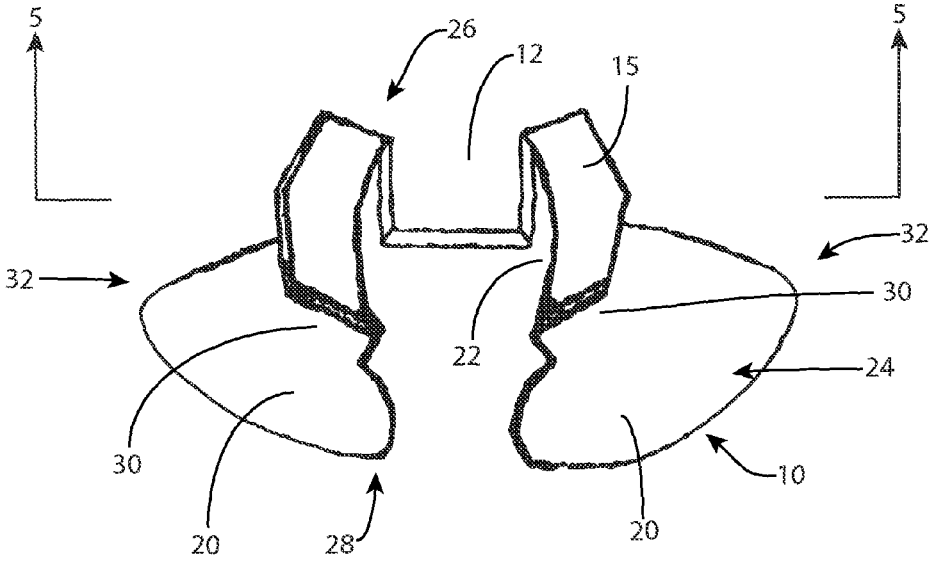
FIG. 2 is a general view of the cervical spine protection device.
Figure 3:
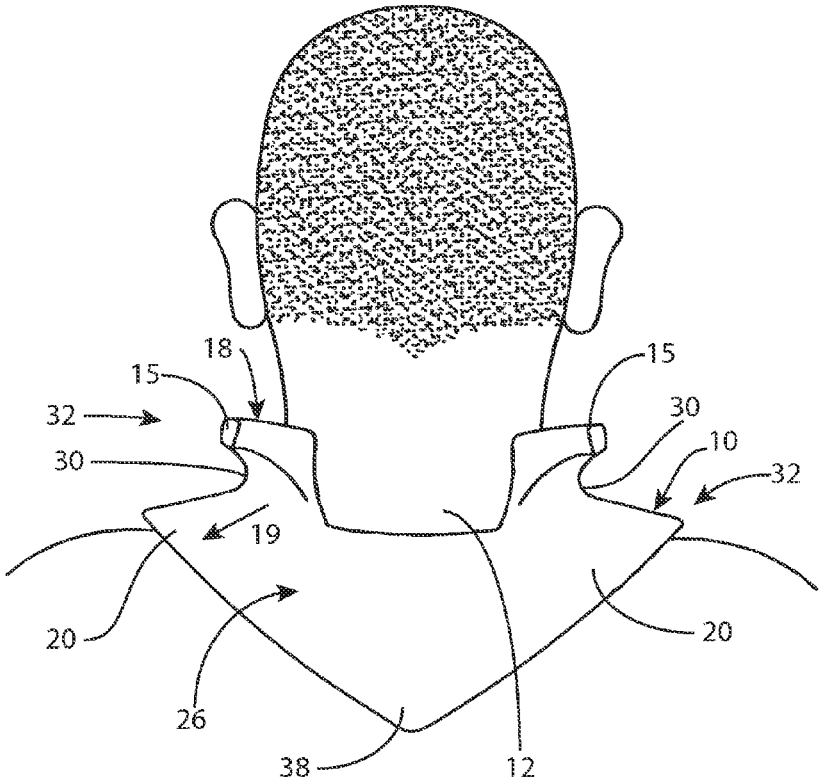
FIG. 3 is a rear view of the cervical spine protection device as worn by the user.
Figure 4:
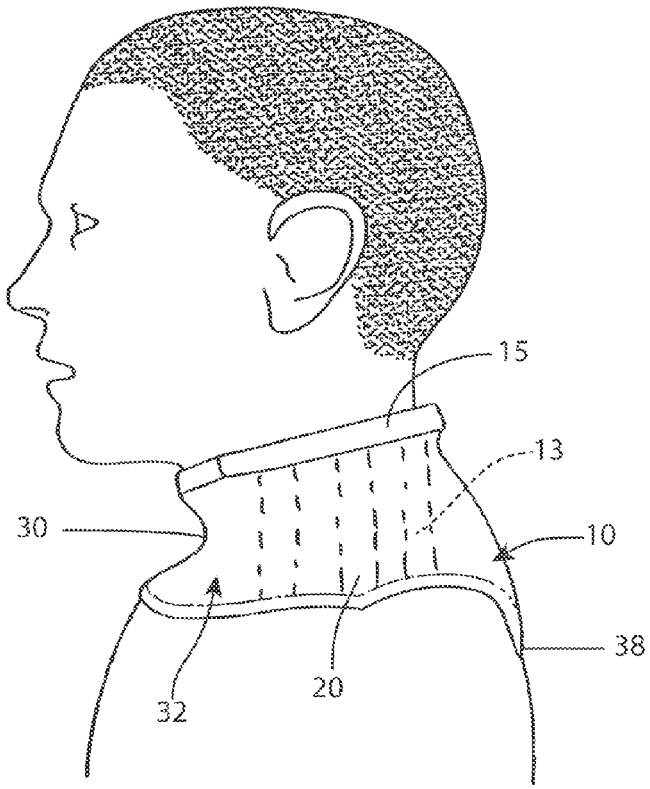
FIG. 4 is a side view of the cervical spine protection device as worn by the user.

Referring now to the Figures, FIG. 1 illustrates a front view of the cervical spine protection device 10 of the present invention as worn by a user, which for this embodiment is shown as a football player. FIGS. 3 and 4 illustrate respectively a rear and side view of the device. Device 10 can be constructed of various materials including plastic, polyurethane or foam. It is to be understood that device 10 can come in different sizes depending on the neck size of the player.

The inventive protection device 10 is designed to be worn in conjunction with a football helmet and football shoulder pads and as illustrated the shape is molded to accommodate the normal anatomy of the upper back and lower cervical spine.

At a back portion 26 of the device 10, there is an opening 12 and similarly there is an opening 14 at a front portion 28 of the device 10. The purpose of these openings is to allow unrestricted movement of the head and neck during athletic movement. The device 10 also includes a middle portion 30 located in a generally centralized elevational position of the device 10, upper portions 15 that extend toward the lower edge 34 of the helmet 11, and lower portions 20 that are shaped/contoured to rest on the shoulders of the user. Further, the device 10 includes side portions 32 in between the back and front portions 26, 28.

The focus of the invention is to absorb the force of an impact at the top 36 of the helmet 11. Most catastrophic injuries in contact sports occur when the head is driven down toward the neck and shoulders producing pressure too great for the cervical spine to handle. This extreme pressure can cause a buckling of the spinal column and can lead to disc herniation, muscle and ligament damage and severe spinal cord injury. The protective device of the present invention provides the necessary support in order to minimize spinal cord injury that could result from excessive force being applied to the top 36 of the player's helmet 11, while at the same time allowing freedom of movement for the head and neck.

Figure 5:
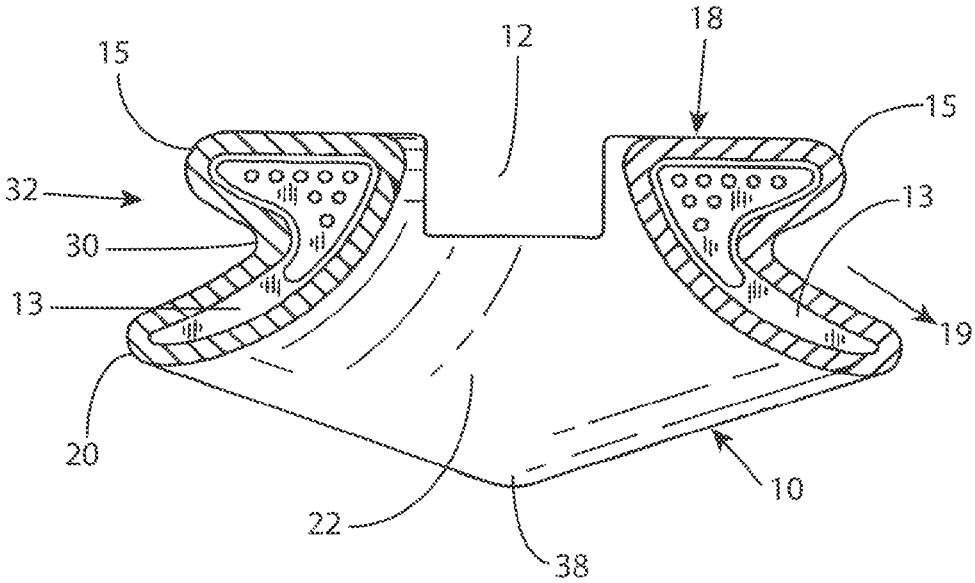
FIG. 5 is a cross section of the cervical spine protection device along line 5 of FIG. 2 showing compression elements embedded in the protection device.
Figure 6:
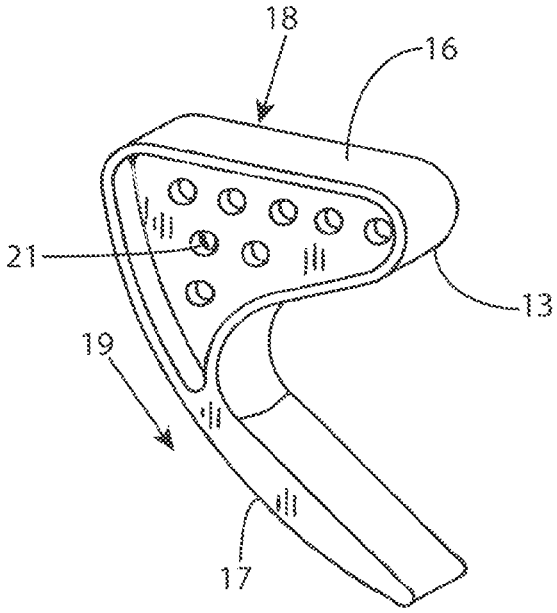
FIG. 6 is a general view of the compression element embedded in the cervical protection device.

More particularly, FIG. 6 illustrates compression element 13, which is inserted within device 10 as shown in FIG. 5. FIG. 5 is a cross-section looking toward the back portion 26 of device 10 illustrating how compression element 13 is inserted within device 10, while FIG. 4 is a side view of device 10 illustrating how a plurality of compression elements 13 may extend around the periphery of device 10. FIG. 4 shows three individual compression elements 13 on the side portions 32 of device 10, but it is to be understood that a greater or lesser number can be used depending on the degree of support required.

Compression element 13 as shown in FIG. 6 can be made from a stiff polyurethane or any similar material that will provide adequate support. Upper surface 16 is designed to support the upper surface of the upper portions 15 to provide a generally wide contact area that may receive the lower edges 34 of the helmet 11 when excessive force is applied to the top 36 of the helmet 11. The width of this contact area on the upper portions 15 can vary depending on the type of helmet worn by the player, but generally the width would be in the approximate range of 2 to 2.5 inches wide at the widest point.

The lower surface 17 of compression element 13 is designed to follow the contours of the player's neck and is specifically shaped to direct force away from the cervical spinal column. This is illustrated by arrow 18 representing a downward force applied to upper surface 16 when excessive force is received at the top 36 of helmet 11, forcing the lower edges 34 of the helmet 11 onto upper portions 15 of the device 10. This force is then directed from a downward direction as shown by arrow 18 to an oblique direction as shown by arrow 19. Apertures 21 shown in FIG. 6 are illustrative only and can be used, if necessary, to reduce the weight of compression element 13 or for other reasons known to those of ordinary skill in the art.

As set forth above, the present invention is designed to protect against spinal cord injury when excessive force is applied to the top 36 of a player's helmet 11, which can result in axial compression of the spine. Injury is minimized by filling the gap between the lower edge 34 (bottom sides and back bottom) of a player's helmet 11 and the lower neck and upper shoulder of the player with the device 10. Force directed at the top 36 of the helmet 11 is applied to device 10 at the upper portion 15 and absorbed by compression elements 13, which direct the force away from the cervical spine. The disclosed invention also allows unrestricted movement of the head and neck during athletic activity.

The shape of the device 10, as shown in the figures, will now be described in more detail. As best shown in FIG. 3, the back portion 26 of the device 10 may include a substantially v-shaped design 38. In an embodiment of the present invention, the back portion of the device 26 also includes an opening 12 that is sized and shaped to allow a person wearing a device 10 and a helmet 11 to move their head and neck backwards (toward their back and away from their chest) without substantial restriction. The opening 12 creates a valley 42 in the back portion 26, which is at a lower point elevationally than the top surface 40 of the upper portion 15 of the device 10 (as shown in FIG. 5). In other words, when wearing the device 10 and a helmet 11, the upper portions 15 would be closer to the lower edge 34 of the helmet 11 than the valley 42 of the back portion 26 (as is evident from FIGS. 1 and 3). Therefore, if a football player were wearing the device 10 and a force was applied to the top 36 of the helmet 11, the valley 42 is at an elevation such that the lower edge 36 of the helmet 11 would contact the top surface 40 of the upper portion 15, and not the valley 42 of the back portion 26.

As discussed herein, the device 10 is shaped to direct a force occurring at the upper portions 15 (arrow 18, i.e., a force in a downward direction on the top surface 40 of the upper portion 15) away from the cervical spine (arrow 19, i.e., an oblique direction). As depicted in FIGS. 1-3 and 5, the outside portion 24 of the device 10 includes a substantially c-shaped design, with the lower portions 20 and the upper portions 15 extending laterally further than the middle portion 30 of the device 10. In an embodiment of the present invention, the lower portions 20 are shaped to fit comfortably on the shoulders of a user beneath the shoulder pads that are typically worn by football players (as is apparent from the shape of the device 10). The upper portions 15 include a top surface 40 that extends from the inside portion 22 of the device 10 to the edge of the side portions 32 of the device 10 beyond the middle portion 30 of the device 10. In an embodiment of the present invention, the shape of the device 10 assists in directing a force occurring at the upper portions 15 (arrow 18, i.e., a downward direction) away from the cervical spine (arrow 19, i.e., an oblique direction).

While there has been described what is considered to be a preferred embodiment of the invention, it will be understood by those skilled in the art that various changes and modifications may be made therein without departing from the invention, and therefore, it is the aim of the appended claims to cover all such changes and modifications as fall within the true spirit and scope of the invention.

I claim:

1. A cervical spine protection device comprising:

a lower portion engaged with a user's shoulders, the lower portion having an opening at a forward facing side of a user's body;

an upper portion designed for engagement with a user's head protection device when an axial force is applied to a top portion of the user's head protection device, the upper portion having an opening at the forward facing side of the user's body and a rearward facing side of a user's body; and a plurality of compression elements within the cervical spine protection device, wherein the axial force applied to the top portion of the user's head protection device is directed away from a cervical spine of the user in an oblique direction and wherein the compression elements comprise a first horizontal portion within and adjacent to the upper portion of the cervical spine protection device and a tapered lower portion designed to follow the contours of a user's neck wherein a force applied to the first horizontal portion is directed along the tapered lower portion away from the user's cervical spine in an oblique direction.

2. The device according to claim 1, wherein the upper portion comprises a width that between 2 and 2.5 inches in length.

3. The device according to claim 1, wherein an equal number of compression elements are distributed along each side of the cervical spine protection device.

4. The device according to claim 1, wherein the cervical spine protection device is made of plastic, polyurethane, or foam.

5. The device according to claim 1, wherein the compression elements are made of a stiff polyurethane material.

6. The device according to claim 1, wherein the opening in the upper portion at the rearward facing side of the user's body is of a width substantially equal to the width of a user's neck.

7. The device according to claim 1, wherein the compression elements include a plurality of apertures.

8. The device according to claim 1, wherein the openings at the forward and rearward facing sides of the user's body are sufficient in size to allow substantially unrestricted movement of a user's head and neck.

9. A cervical spine protection device comprising:

an inside portion shaped to fit around a user's neck;

an outside portion comprising an upper portion, a lower portion, and a middle portion, wherein the middle portion is located between the upper portion and the lower portion;

a front portion; and a back portion, wherein the lower portion is shaped to engage with a user's shoulders, wherein the back portion includes an opening that is sized and shaped to allow a user to move their head and neck backwards without substantial restriction, wherein the outside portion comprises a substantially c-shaped design, with the lower portion and the upper portion extending laterally further than the middle portion away from the user's neck, a plurality of compression elements embedded within the cervical spine protection device, wherein the compression elements comprise a first horizontal portion within and adjacent to the upper portion and a tapered lower portion designed to follow the contours of the user's neck, and wherein, when a force is applied to a top surface of the upper portion, the device directs the force away from the user's cervical spine in an oblique direction.

10. The device according to claim 9, wherein the device is made of plastic, polyurethane, or foam.

11. The device according to claim 9, wherein the opening in the back portion includes a valley that is at a lower point elevationally than the top surface of the upper portion.

12. The device according to claim 9, wherein a width of the upper portion is approximately between 2 and 2.5 inches.

13. The device according to claim 9, wherein the inside portion includes a tapered lower portion designed to follow contours of the user's neck, and wherein the force applied to the top surface of the upper portion is directed along the tapered lower portion away from the user's cervical spine in an oblique direction.

14. The device according to claim 9, wherein the back portion includes a substantially v-shaped design.

15. The device according to claim 9, wherein the lower portion extends further than the upper portion.

16. The device according to claim 9, wherein the top surface of the upper portion is designed to engage a lower edge of a helmet when a force is applied to a top of the helmet.

17. The device according to claim 9, wherein the front portion includes an opening that creates a separation in the device.

18. A cervical spine protection device comprising:

an inside portion shaped to fit around a user's neck;

an outside portion comprising an upper portion, a lower portion, and a middle portion, wherein the middle portion is located between the upper portion and the lower portion;

a front portion including an opening through the entire device; and a back portion including an opening that is sized and shaped to allow a user to move their head and neck backwards without substantial restriction, wherein the opening in the back portion includes a valley that is at a lower point elevationally than a top surface of the upper portion, wherein the outside portion comprises a substantially c-shaped design, with the lower portion and the upper portion extending laterally further than the middle portion away from the user's neck, wherein the upper portion does not extend as far as the lower portion, a plurality of compression elements embedded within the cervical spine protection device, wherein the compression elements comprise a first horizontal portion within and adjacent to the upper portion and a tapered lower portion designed to follow the contours of the user's neck, wherein, when a force is applied to the top surface of the upper portion, the device directs the force away from the user's cervical spine in an oblique direction, and wherein the top surface of the upper portion is designed to engage a lower edge of a helmet when a force is applied to a top of the helmet.

* * * * *